US010661137B1

(12) United States Patent
Nicely

(10) Patent No.: US 10,661,137 B1
(45) Date of Patent: May 26, 2020

(54) SPORTS AIDE

(71) Applicant: V-Flex Technologies, Inc., Kingsport, TN (US)

(72) Inventor: Timothy J. Nicely, Bean Station, TN (US)

(73) Assignee: V-Flex Technologies, Inc., Kingsport, TN (US)

( * ) Notice: Subject to any disclaimer, the term of this patent is extended or adjusted under 35 U.S.C. 154(b) by 0 days.

(21) Appl. No.: 16/361,725

(22) Filed: Mar. 22, 2019

(51) Int. Cl.
*A63B 69/00* (2006.01)
*A63B 63/00* (2006.01)
*A63B 63/06* (2006.01)

(52) U.S. Cl.
CPC ..... *A63B 63/06* (2013.01); *A63B 63/004* (2013.01); *A63B 63/00* (2013.01); *A63B 69/0002* (2013.01); *A63B 69/0075* (2013.01)

(58) Field of Classification Search
CPC ..... A63B 63/06; A63B 63/004; A63B 63/00; A63B 69/0075; A63B 69/0002
USPC ..... 473/446, 422, 476, 454, 398, 456, 439; 273/402, 369, 343, 392, 400, 407; D21/303, 699
See application file for complete search history.

(56) References Cited

U.S. PATENT DOCUMENTS 687,873 A * 12/1901 Daniels ..... F41J 7/04 273/390
1,258,931 A * 3/1918 Newcombe ..... A63B 67/06 273/402
1,435,768 A * 11/1922 Wang ..... F41J 5/20 273/392
1,598,865 A 9/1926 Limerick
1,965,838 A 7/1934 Stanley
2,113,719 A * 4/1938 Creswell ..... F41J 7/04 273/390
2,126,102 A 8/1938 Fowier
2,580,799 A * 1/1952 Lauterbach ..... A63B 63/00 473/476
2,926,914 A * 3/1960 Miller ..... A63F 7/305 273/352
4,057,248 A 11/1977 Stoecker
4,079,939 A * 3/1978 Raistakka ..... A63B 67/06 273/402
4,097,044 A * 6/1978 Miniere ..... A63B 69/0002 473/451
4,295,648 A * 10/1981 Stromback ..... A63B 63/00 473/456
4,497,485 A 2/1985 Macosko
4,635,943 A * 1/1987 Lumpkin ..... A63B 67/06 473/588
4,872,674 A 10/1989 Deal
4,936,578 A * 6/1990 Hudson, Sr. ..... A63B 63/00 473/439
4,955,607 A * 9/1990 Maye ..... A63B 63/00 473/456
5,330,199 A * 7/1994 Vand ..... A63B 53/04 273/400

(Continued)

*Primary Examiner* — Mitra Aryanpour
(74) *Attorney, Agent, or Firm* — Luedeka Neely Group, PC

(57) ABSTRACT

A sports aide for training a player to throw or kick a ball, comprising a spinning ring positionable proximal to the player and sized for passage of a ball therethrough, wherein during use of the aide the player will throw or kick the ball and attempt to have the thrown or kicked ball pass through the spinning ring.

4 Claims, 3 Drawing Sheets

(56) References Cited

U.S. PATENT DOCUMENTS 5,395,122 A * 3/1995 Kraemer ..... A63B 63/00 473/195
5,433,434 A 7/1995 Helmetsie
5,704,855 A 1/1998 Kellogg, Jr.
5,833,556 A * 11/1998 Ferrari ..... A63B 69/0071 473/448
5,944,318 A * 8/1999 Payton ..... A63B 63/00 473/476
6,068,488 A * 5/2000 Sinsheimer ..... A63B 69/002 473/466
6,135,900 A * 10/2000 McGrath ..... A63B 69/0002 473/423
6,620,065 B2 * 9/2003 Clabough ..... A63B 63/00 473/454
6,939,241 B1 9/2005 Chang
7,090,596 B2 * 8/2006 David ..... A63B 63/00 473/439
7,134,977 B2 * 11/2006 Campbell ..... A63B 63/06 473/454
7,534,178 B2 * 5/2009 Nicely ..... A63B 69/0002 473/421
7,648,421 B2 1/2010 Yoon
7,931,547 B2 4/2011 Bishop
8,900,076 B1 * 12/2014 Shropshire ..... A63B 69/002 473/439
D730,460 S * 5/2015 Zampese ..... D21/699
9,739,576 B1 8/2017 Venigalla
10,132,600 B2 * 11/2018 Saunders ..... F41J 7/04 273/390
2002/0091021 A1 7/2002 Clabough
2004/0104534 A1 6/2004 Trapani
2005/0012266 A1 1/2005 Kelley et al.
2008/0171619 A1 7/2008 Nicely
2008/0248901 A1 10/2008 Mosier et al.
2012/0065003 A1 3/2012 Trout
2015/0321062 A1 11/2015 Tyndall

* cited by examiner

SPORTS AIDE

FIELD

This disclosure relates to the field of sports aides. More particularly, the disclosure relates to a sports aide configured to improve accuracy in throwing or kicking of a ball.

BACKGROUND

Improvement is desired in aides for improving accuracy in throwing or kicking balls, such as occurs in the sports of football, soccer and the like. For example, in football, a quarterback is generally under pressure from a defender, as is a receiver, and the quarterback must be able to take advantage of a moment when it is most opportune to throw a pass to a receiver. This requires visual recognition of the moment and then quickness in throwing a pass at that moment, in addition in accuracy in passing.

This is similar in soccer as a player must take advantage of opportunities to score and accurately kick the ball. Further, in the circumstances of a free kick in soccer, the player is not under pressure from a defender, but is watchful of the goalie and may decide to kick the ball to the right of the goal if the player recognizes that the goalie has slightly leaned to their left in anticipation of the shot.

The present disclosure advantageously provides a sports aide configured to train a player in recognizing an opportune moment to throw or kick a ball or the like and to develop quickness and accuracy in doing so.

SUMMARY

The above and other needs are met by sports aides configured to train a player in recognizing an opportune moment to throw or kick a ball and to develop quickness and accuracy in doing so.

In one aspect, a sports aide according to the disclosure includes a spinning ring positionable proximal to the player and sized for passage of a ball therethrough. During use of the aide the player will throw or kick the ball and attempt to have the thrown or kicked ball pass through the spinning ring.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

With reference to the drawings, there is shown a sports aide 10 configured for use in training a configured to train a player in recognizing an opportune moment to throw or kick a ball and to develop quickness and accuracy in doing so.

Figure 1:
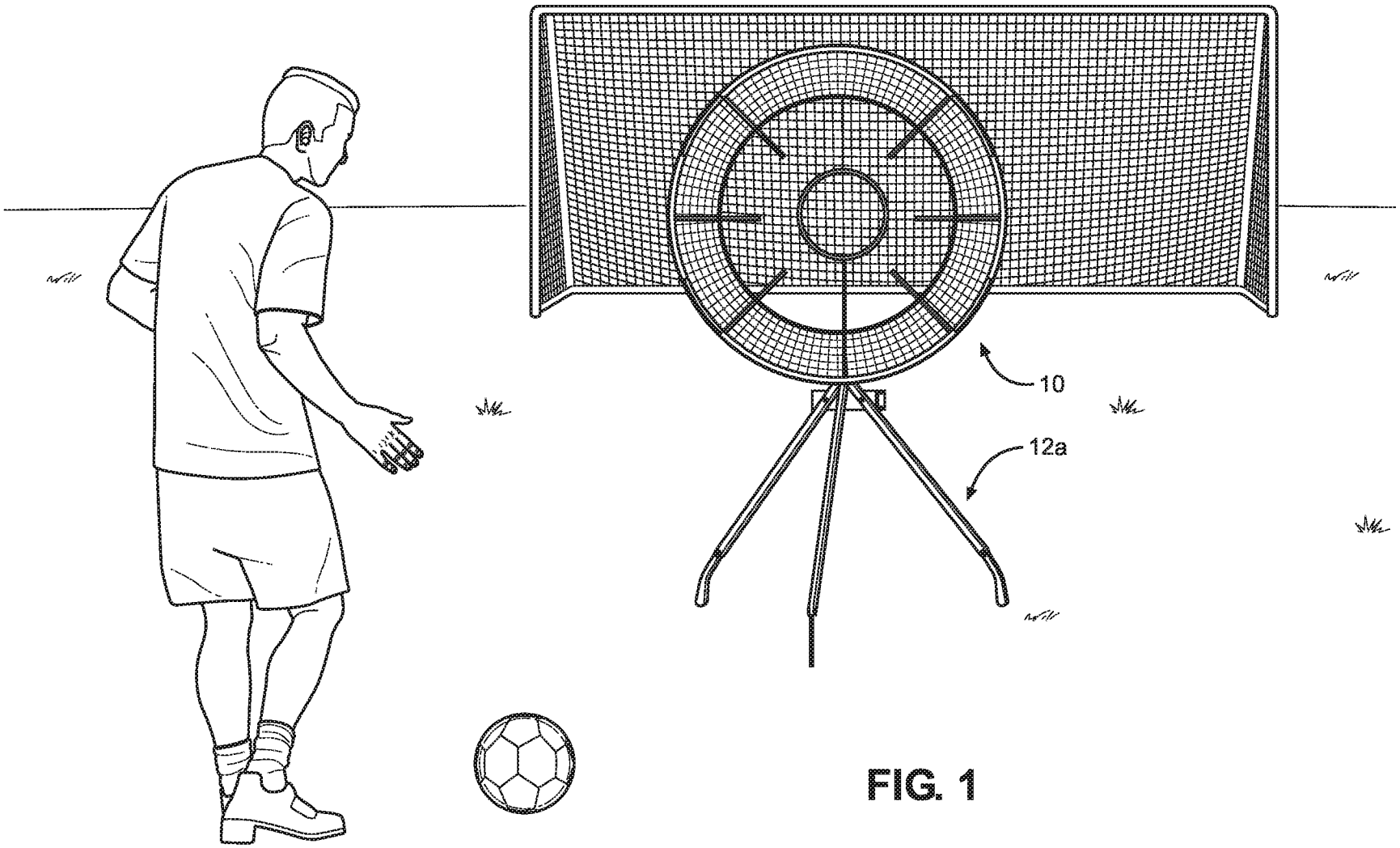
FIG. 1 is a perspective view showing a sports aide and use thereof for training in the kicking of a soccer ball according to the disclosure.
Figure 2:
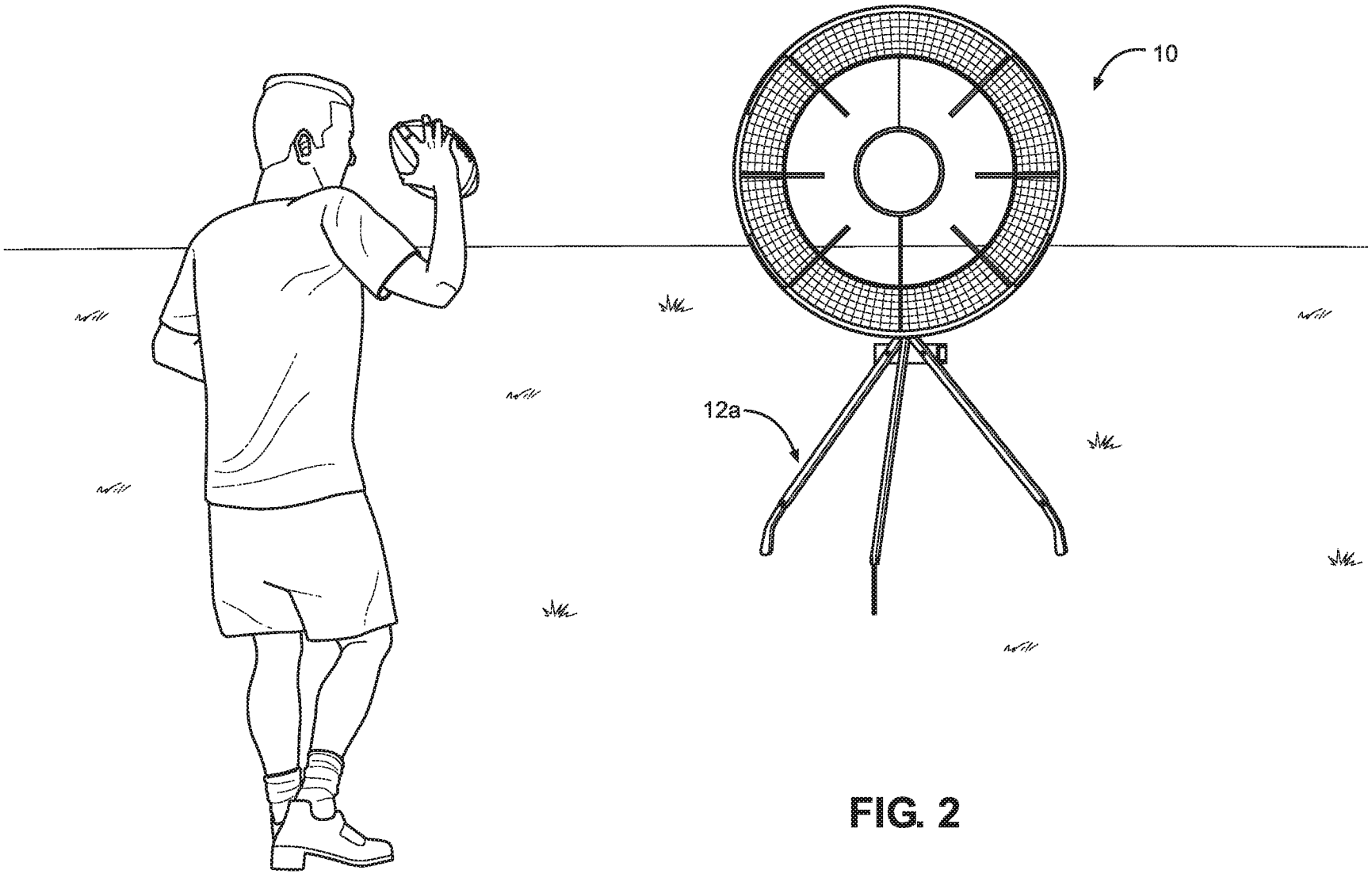
FIG. 2 is a perspective view showing a sports aide and use thereof for training in the throwing of a football according to the disclosure.

The aide 10 is particularly configured to train soccer players and football players, as shown in FIGS. 1 and 2, respectively.

Figure 3A:
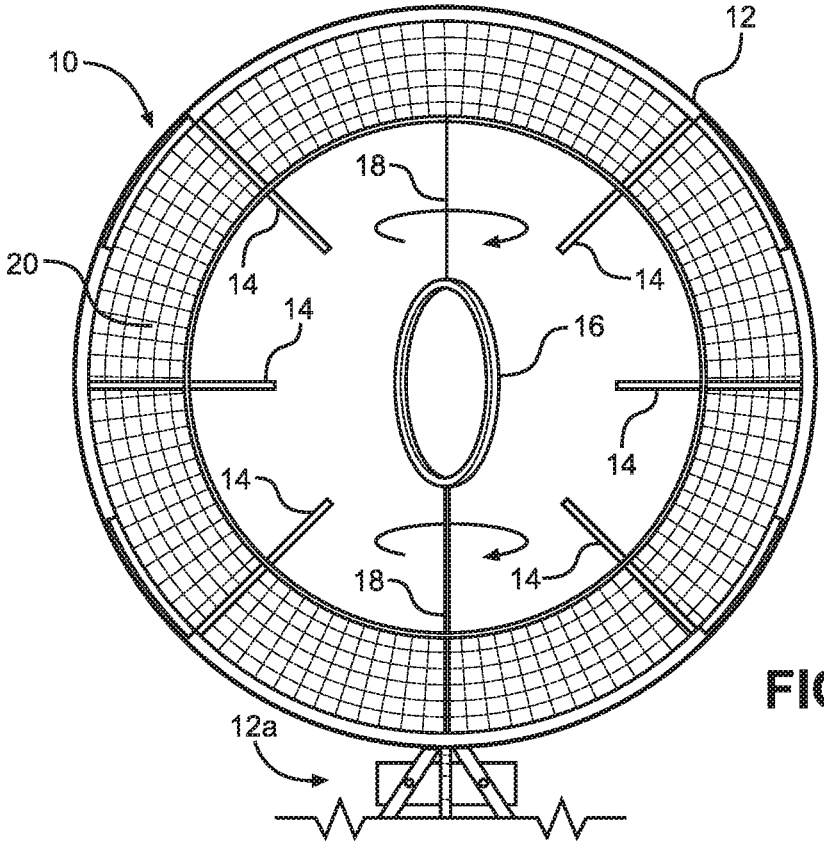
FIGS. 3A and 3B show construction aspects and operation of sports aides according to the disclosure.
Figure 3B:
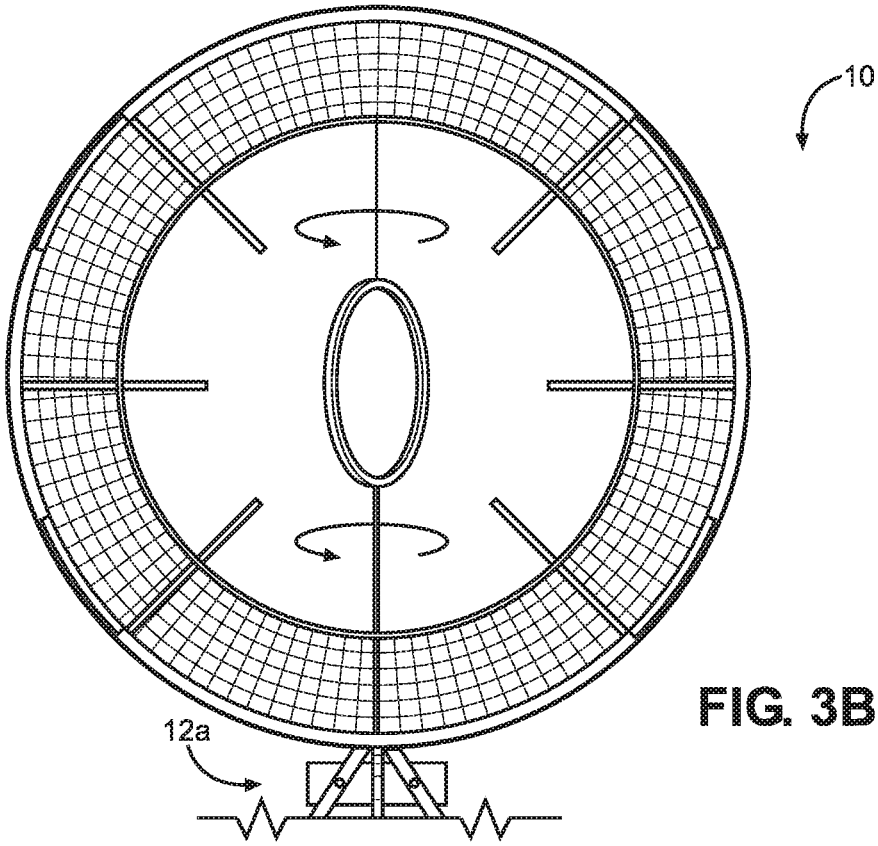

With additional reference to FIGS. 3A and 3B, the aide 10 includes a circular frame 12 having a plurality of elongate radial members 14 that extend inwardly from the frame 12 toward a center of the frame 12, and a spinning ring 16 rotatably mounted on the frame 12.

The spinning ring 16 may be rotatably mounted in various manners to spin, such as by one or more motorized rotatable members 18 driven as by a key-wound gear motor or battery powered electric motor or the like. The rate of rotation/spinning may be selectively adjusted and varied. For example, the ring 16 may spin at a selected constant rate, or varied.

As shown, a radial fill material 20 such as netting, may be located around an inner perimeter of the frame 12 if desired. The radial members 14 and the fill material 20 are believed to further enhance visual focus of the player to the spinning ring 16.

The radial members 14 cooperate to define a central circular open area in which the spinning ring 16 is located and spaced inwardly from distal ends of the radial members 14. The frame 12 is adjustably positionable a desired height above the ground as by adjustable frame supports 12*a*.

Returning to FIG. 1, a player may use the aide 10 as by placing the aide between the player and a soccer goal and practice by trying to kick a soccer ball through the spinning ring 16 and into the soccer goal. This may, for example, replicate a free kick. If desired, the player may utilize a defender and dribble the soccer ball toward the aide while being defended and then attempt to kick the soccer ball through the spinning ring 16 while being guarded. As will be appreciated, success in overcoming the additional challenges provided by the aide 10 will serve to help the player to develop skills to take advantage of opportunities to kick the ball and to more accurately kick the ball In a similar manner, as shown in FIG. 2, a player may use the aide 10 by trying to through a football through the spinning ring 16. If desired, the player may utilize a defender on the player and/or a receiver or other moving target, with the spinning ring 16 serving as a defender on the receiver or other moving target. Thus, not only does the player have to time the throw with the rotation of the spinning ring 16, the player must also time the throw in accordance with the movement of the moving target. As will be appreciated, success in overcoming the additional challenges provided by the aide 10 will serve to help the player to develop skills to take advantage of opportunities to pass the ball and to more accurately pass the ball.

Without being bound by theory, the aide 10 is believed to be configured to engage the brain of the player during training sessions by enhancing the neurological space which defines a successful shot on goal or completed pass. These engineered spaces assist the player in judging timing and distance variables that correlate to a successful shot on goal or completed pass. To achieve the desired consistency and effectiveness the brain of the player must be exercised using a constraint led approach. This requires placing the brain under an implicit neurological constraint as well as an explicit time constraint.

Placing the brain's electrical system under a constraint requires manufacturing a neurological constraint from electrical impulses from within brain. Greater pass or shot efficiency and consistency is achieved by manipulating the ability of the brain to exercise within its own electrical parameters.

The spaces or gaps between the elongate radial members 14 and the spinning ring 16 are believed to cause brain of the player to fire an electrical impulse every ½ revolution of the ring 16. These neurological events serve as a coordinate (distance) marker inside the brain of the player. This is because the brain is firing impulses in the gap locations which allow the brain to convert depth perception into an absolute location implicitly, (subconsciously). This neurological activity alters the outcome of a locomotor related activity or task being performed by altering the amount of cognitive input necessary to perform the task.

Training in an environment where a constraints led approach can be manipulated via neuro-electrical impulses through visual prompts is paramount to building the internal confidence associated with becoming a successful passer. The aide 10 may be placed at different distances in order to create a more stimulating environment. Beginner or basic distances are desirably 5-10 yards. Intermediate distances are 11-20 yards and advanced distance is beyond 21 yards. Likewise, as the distance increases, so may the rotational speed of the ring 16 be increased. The rotational speed may also be adjusted to correspond to game parameters. The sizes of the frame and spinning ring may also be selected in order to increase and decrease the difficulty of a particular drill or exercise.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A sports aide for training a player to throw or kick a ball, comprising: a circular frame; a spinning ring suspended and centered within the circular frame and powered to spin by a motor connected to the spinning ring, the spinning ring being positionable proximal to the player and sized for passage of a ball therethrough, wherein during use of the aide the player will throw or kick the ball and attempt to have the thrown or kicked ball pass through the spinning ring as the spinning ring is spinning.

2. The aide of claim 1, further comprising a plurality of elongate radial members that extend inwardly from the frame toward a center of the frame.

3. The aide of claim 1, further comprising a soccer goal located distally of the spinning ring and during use of the aide the player attempts to kick the ball through the spinning ring and into the soccer goal.

4. The aide of claim 1, further comprising a moving target located distally of the spinning ring and during use of the aide the player attempts to throw the ball through the spinning ring and to the moving target.

* * * * *